United States Patent [19]

Zoland

[11] 4,077,451

[45] Mar. 7, 1978

[54] EXPANDABLE BAG

[76] Inventor: Martin Zoland, 76 Raglan Street, Preston, Melbourne, Australia, 3072

[21] Appl. No.: 753,731

[22] Filed: Dec. 23, 1976

[30] Foreign Application Priority Data

Dec. 13, 1976 United Kingdom ..... 51953/76

[51] Int. Cl.[2] ..... A45C 7/00

[52] U.S. Cl. ..... 150/31; 150/1; 190/43; 190/50

[58] Field of Search ..... 150/35, 31, 28 R, 1, 150/3; 190/44, 50, 21, 24, 43; 46/146

[56] References Cited

U.S. PATENT DOCUMENTS

| | | | |
|---|---|---|---|
| 1,045,510 | 11/1912 | Campbell | 150/2.7 X |
| 1,051,716 | 1/1913 | Eiseman | 150/31 |
| 1,557,592 | 10/1925 | Jones | 46/146 X |
| 1,650,762 | 11/1927 | Machin | 46/146 X |
| 2,024,908 | 12/1935 | Blum | 150/2.7 |
| 2,151,999 | 3/1939 | Stember | 150/10 |
| 2,798,579 | 7/1957 | Fox | 190/43 |

*Primary Examiner*—Donald F. Norton
*Attorney, Agent, or Firm*—Ostrolenk, Faber, Gerb & Soffen

[57] ABSTRACT

The invention relates to an apparatus for permitting the shipment of flexible sided bags such as cosmetic bags, purses, soft-sided luggage and handbags in a flattened condition with means provided within the bag by which the bag may be expanded to present an attractive appearance at the point of sale. In shipping of merchandise, freight payments are made, not only with respect to weight, but also with respect to volume. By providing a device which may be inserted in the bag at the point of manufacture, and may be expanded at the point of display by merely pulling a string, the bag may be shipped flat and erected for a suitable attractive appearance at the point of sale. Thus, a pair of parallel members such as cards are provided which are compressed toward each other and are biased apart by a spring. A pin which passes through a locking eyelet in an extension from one side of the interior of one of the cards through to the outer side of the other card locks the cards together. The pin may be connected to a string which extends outside the bag while the bag is closed. The retailer may merely pull on the string to pull the pin out from its locking position to permit the spring member to perform the extending operation.

7 Claims, 8 Drawing Figures

FIG. 1.
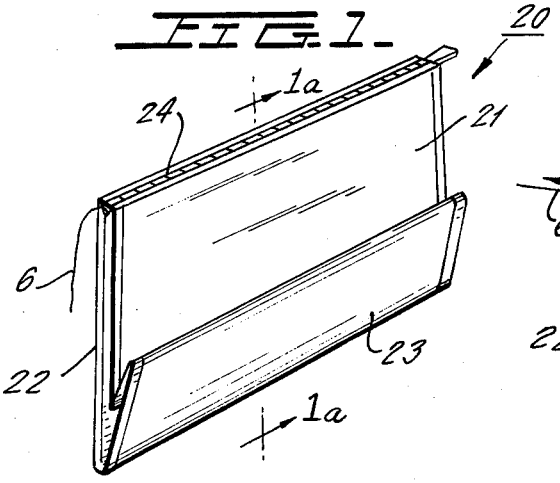
FIG. 2.
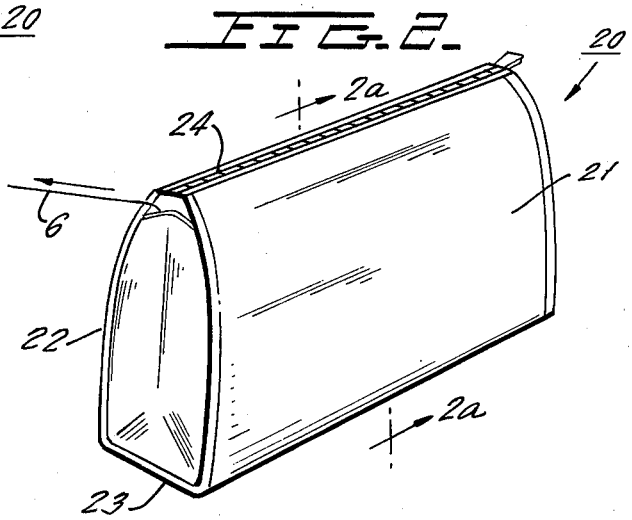
FIG. 1a.
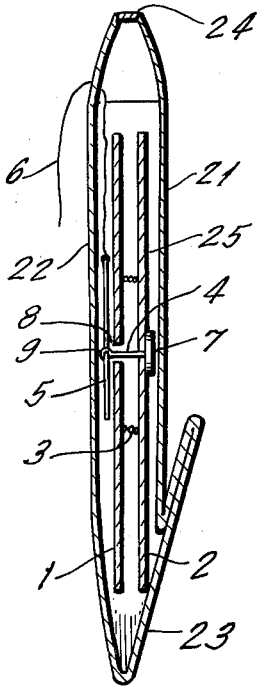
FIG. 2a.
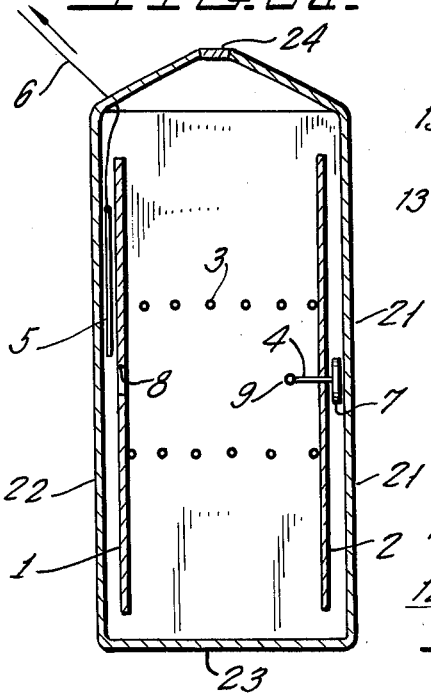
FIG. 5.
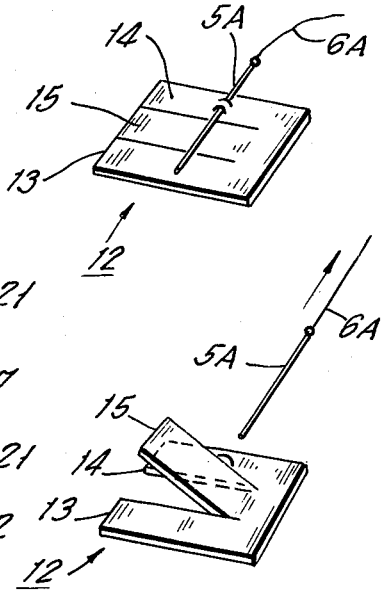
FIG. 6.
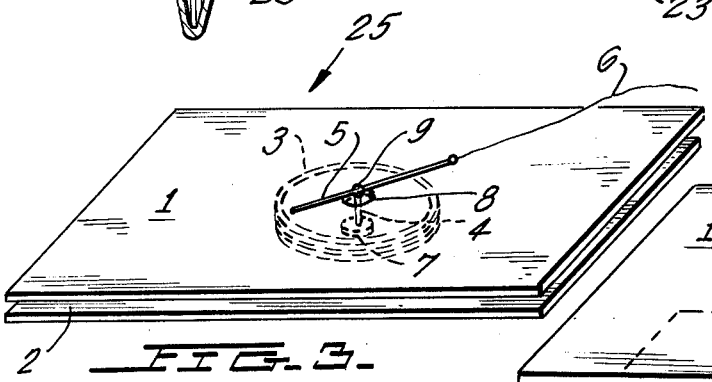
FIG. 3.
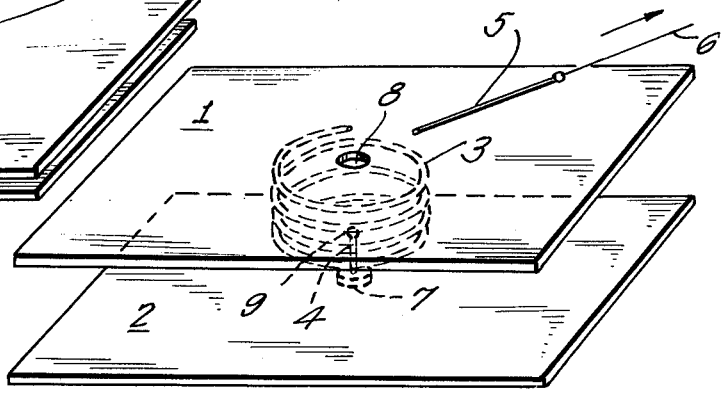
FIG. 4.

EXPANDABLE BAG

BRIEF DESCRIPTION OF THE PRESENT INVENTION

This invention relates to a method and apparatus for expanding articles for point-of-sale presentation.

Particularly in the bag market, such as flexible sided cosmetic bags, purses and luggage, there is a conflict between the needs of transporters or shippers to pack the bags flat for minimum freight charges and the needs of retailers for the bags to be expanded, rather than flattened, when they are on display.

The invention provides a device which can be inserted inside a hollow article, such as a bag, while in a flat condition, and, at any stage in the future, can be activated to expand the bag. The device comprises manually compressible biasing means, and a releasing member which holds the biasing means compressed, and can be released to permit the biasing means to expand.

Preferably, the releasing member is released by movement at right angles to the direction of expansion of the biasing means.

The compressible biasing means can take a number of forms. It may for example be a helical compression spring or a leaf spring or other expanding device. A helical spring may be most appropriate, becuase this can provide a large ratio between compressed and expanded sizes and can also provide a relatively large expanding thrust.

BACKGROUND OF THE INVENTION AND BROAD DESCRIPTION THEREOF

In the following description, the biasing means will be referred to as a spring. This is simply for convenience of description and is to be understood as not limiting the type of biasing means to be chosen.

Preferably a flat card will be mounted on each side of the spring, so that the card lies in a plane at right angles to the direction of expansion. The spring will preferably be attached to the card on each side: for example, two projections on each end of the spring engage in corresponding holes in the cards in order to maintain the spring in the correct position. The cards obviously should be of smaller dimensions than the internal dimensions of the bag, so that they can be inserted and the bag closed. The cards may, in fact, be considerably smaller than the bag, and a limited range of card sizes may be used over a large range of bag sizes. The cards need not be the same size on opposite sides of the spring. The larger card would then locate the spring in the correct position in the bag and the smaller card would provide a contact area for pushing a side of the bag outwards.

The releasing member may be a pin inserted in the coils of the spring, if a helical spring is used, or could be a pin engaging a tie-piece extending from the card on one side of the spring to the card on the other side. If such a pin is used, a thread is preferably attached to one end of the pin and this thread is led out of one corner of the bag so that the pin can be released without opening the bag. If the bag is itself contained in a protective polythene bag, the thread can extend out of this bag too, so that no unwrapping would be needed.

It is advantageous if the movement of the releasing member required to release the spring is at right angles to the direction of expansion of the spring (i.e. parallel to the cards, if these are used). This makes it possible to operate the device to expand the bag, without opening the bag.

The invention also extends to a method of packing bags, wherein the bags each have inserted in them a biasing means, and the bags are then compressed as they are packed into a container, so that the biasing means is compressed and the bags occupy little space.

It is already known to pack bags with foam rubber or other inserts. Although such a method might fall within the terms of the definition above, they do not satisfactorily perform the same object, and so it is envisaged that the present invention should be restricted to biasing means which have an expanded size which is say at least five times the compressed size.

In a preferred method however, the biasing means are compressed and held compressed by a separate member before being inserted in the bags. No compression is then necessary when the bags are actually packed in their container.

Preferably the device is inserted in such a way that the member holding the biasing means compressed can be released without opening the bag.

SPECIFIC DESCRIPTION OF THE INVENTION

The foregoing and many other methods of practicing the invention as well as other objects of the present invention will become apparent in the following description and drawings in which:

FIG. 1 is a view in perspective of a cosmetic bag constructed in accordance with my invention, and arranged for flat packing for shipment.

FIG. 2 is a view in perspective, corresponding to FIG. 1 showing the same cosmetic bag fully expanded.

FIG. 1*a* is a cross-sectional view taken on line 1*a*—1*a* of FIG. 1 looking in the direction of the arrows and showing the insert member collapsed and prepared for expansion.

FIG. 2*a* is a cross-sectional view taken on line 2*a*—2*a* of FIG. 2 looking in the direction of the arrows and showing the insert member fully expanded in order to expand the bag from the position of FIG. 1 to the position of FIG. 2.

FIG. 3 is perspective view of the expanding device of FIGS. 1 and 1*a*, showing the same locked in collapsed position.

FIG. 4 is a view in perspective corresponding to that of FIG. 3 showing the expanding device released for expansion to expand the bag from the position of FIG. 1 to the position of FIG. 2.

FIG. 5 is a view in perspective of a modified form of a spring arrangement which may be mounted on the interior of one of the cards of FIG. 1 to 4 used in connection with the expanding element of FIG. 3 and 4.

FIG. 6 is a view in perspective corresponding to that of FIG. 5 showing the lock for the expanding element of FIG. 5 released.

Referring now more specifically to the drawings, FIG. 1 shows a cosmetic bag 20 having (see also FIG. 1*a*), sidewalls 21 and 22 and a bottom flap 23 as well as a top closure 24. The expanding device of FIG. 3 is shown inserted in the bag of FIG. 1 as illustrated more specifically in the cross-sectional view of FIG. 1*a*. The expanding device 25 consists of two cards 1, 2 a spring 3 between the cards, a tie-member 4 passing through both cards and a release pin 5 passing through a hole in one end of the tie-member 4. A thread 6 is attached to one end of the pin 5. The drawing is only schematic, and in practice the cards 1, 2 will preferably be closer together than they are shown in FIGS. 1*a* and 3. This will however depend on the form and characteristics of the spring. If a tapered conical helical spring were used, the compressed device would take up less room. The spring is held compressed by the pin 5 through tie-member 4. The tension of the spring holds pin 5 firmly against card 1. This tie-member has a large head 7 at one end, which abuts one side of card 2, and an eye at the other end which projects through a hole 8 in card 1, and through which the pin 5 passes. The hole 8 is made large, so that there is no chance of the eye 9 catching on the edge of the hole when the pin is pulled out.

As can be seen in FIG. 3, the pin is arranged so that it can be pulled from the direction of one corner of the card. Particularly in the case of zip-closing bags, there is often a small aperture, through which thread 6 can pass, at one end of the zip, even when this is closed. The pin can therefore be pulled without opening the bag. After the pin has been pulled and the bag expanded, the pin remains in the bag (although it may be withdrawn if desired). When the bag is to be used, the device with all its parts is removed from the open bag, and discarded.

The spring should be attached to the cards in any suitable way. It may be glued on, held on by projections on the spring projecting into holes on the cards, or in any other suitable way.

The method described for holding the spring in compression is only one example of methods that may be used. Although a straight pull is the simplest way of releasing the spring, releasing by alternative manual manipulations is possible. Cooperating formations could be provided on turns of the spring at each end, and a pin passed through these formations to hold the two ends of the spring together. The end of the pin remote from the thread may be enlarged to prevent accidental release.

More than one spring could be used. If the bag to be expanded is large, this may be particularly appropriate.

The invention is not limited in its application to bags. It may be used in other hollow collapsible articles, where it is desired to store the articles flat, but to expand them for display. In FIGS. 5 and 6 an alternate form of leaf spring arrangement is formed in which the leaf spring 12 may have two legs 13 and 14 secured for instance to the card member 2 and the middle spring leg 15 pressing against the card member 1. In this case, the pin 5*a* (corresponding to the pin 5 of FIGS. 1*a*, 2*a*, 3 and 4) may actually extend inside the pair of cards 1 and 2 and nevertheless be available to be drawn out by the string 6*a* from the locked or collapsed position shown in FIG. 5 to the expanded position shown in FIG. 12.

In an alternative further embodiment, it is envisaged that frames of a material such as polystyrene or low density polyethylene could be used instead of cards. The geometry of a pair of frames could be arranged so that they were held together against the spring force, with a single pin which, when released by pulling it out of the polystyrene material would permit the two frames to spring apart.

In the foregoing, the present invention has been described solely in connection with preferred illustrative embodiments thereof. Since many variations and modifications of the present invention will now be obvious to those skilled in the art, it is preferred that the scope of this invention be determined, not by the specific disclosures herein contained, but only by the appended claims.

What is claimed is:

1. An expandable bag having a closure;
and insert in said bag;
said insert comprising a pair of parallel sheet members;
A first means biasing said parallel sheet members apart;
A second means connected to said sheet members latching said sheet members against relative movement in response to said first biasing means;
And a third means connected to said second latching means adapted to move said latching means to a disengaged position in which said first biasing means may drive said sheet members apart within said bag.

2. The bag of claim 1 wherein said first biasing means comprises a spring compressed between said sheets.

3. The bag of claim 2 wherein said second latching means comprises a member extending between the two sheets, one end of said member bearing against the exterior surface of one sheet;
an opening in the other sheet;
said member extending through said opening in said other sheet.

4. The bag of claim 3 wherein said third means comprises a string connected to said second latching means and extending through said closure.

5. The bag of claim 4 wherein said member extending through said opening in said other sheet
has an eyelet;
said third means comprising the string being connected to a pin and said pin extending through said eyelet, said string being adapted to pull said pin out of said eyelet;
said sheets expanding the bag on the pulling of the pin out of the eyelet.

6. The bag of claim 5 wherein said first biasing means is a helical spring captured between the two sheets.

7. The bag of claim 6 wherein said helical spring is conically tapered.

* * * * *